United States Patent [19]

Pittman

[11] Patent Number: 4,840,102

[45] Date of Patent: Jun. 20, 1989

[54] HIGH DENSITY HEADPLATE FOR A STRINGED INSTRUMENT

[76] Inventor: R. Aspen Pittman, 13994 Simshaw, Sylmar, Calif. 91342

[21] Appl. No.: 31,289

[22] Filed: Mar. 27, 1987

[51] Int. Cl.[4] ..... G10D 1/12

[52] U.S. Cl. ..... 84/293

[58] Field of Search ..... 84/304, 305, 306, 307, 84/290, 291, 292, 293, 293 TR

[56] References Cited

U.S. PATENT DOCUMENTS

| | | | |
|---|---|---|---|
| 548,475 | 10/1895 | Streicher | 84/304 X |
| 1,409,064 | 3/1922 | Richter | 84/305 |
| 2,029,134 | 1/1936 | Stanley et al. | 84/304 |
| 2,128,460 | 8/1938 | Harlin | 84/306 |
| 4,197,779 | 4/1980 | Holman | 84/307 X |
| 4,576,080 | 3/1986 | McLellan et al. | 84/304 X |
| 4,635,522 | 1/1987 | Excellente | 84/291 |

*Primary Examiner*—L. T. Hix
*Assistant Examiner*—Brian W. Brown
*Attorney, Agent, or Firm*—Christie, Parker & Hale

[57] ABSTRACT

A high density headplate (12) made of brass or other metal is secured between a stringed instrument's headstock (10) and its tuning machine (20). This both increases the angle (A) of the string (14) at the nut (16) and effectively increases the density of the headstock which results in a noticeable increase in sustain as well as an improvement in the perceived frequency response of the instrument.

9 Claims, 1 Drawing Sheet

10
12
12'
14
16
18
20
22
24
26
28
32
34
A
5

HIGH DENSITY HEADPLATE FOR A STRINGED INSTRUMENT

TECHNICAL FIELD

The present invention relates to the construction of stringed musical instruments, and more particularly to improvements to the instrument's headstock to improve the sustain and frequency response of such an instrument.

BACKGROUND ART

The strings of an electric guitar or other stringed instrument are attached at one end to a bridge on the body of the instrument, and at the other end to a tuning mechanism on the head of the instrument (in the case of an electric guitar, a geared mechanism that is commonly referred to as the tuning machine). While there has been much attention to improving the guitar's performance by redesigning the tuning machines, the nut, and the bridge system, little has been done to the headstock to improve the acoustic performance of the instrument. U.S. Pats. Nos. 4,197,779 (Holman); 2,128,460 (Harlin); 2,029,134 (Stanley); 548,475 (Streicher); 1,409,064 (Richter) and 4,576,080 (McLellan) are deemed representative of such prior art efforts. In particular, the prior art did not recognize the acoustic benefits of provding a headplate thicker and/or denser than merely required to support the tuning mechanism.

DISCLOSURE OF INVENTION

I have discovered that by installing a relatively thick plate of a relatively dense metal (preferably brass) between the head and the tuning gears on the rear of the instrument's headstock, it changes both the angle of the strings at the nut and the density of the headstock which results in a noticeable increase in the sustain of the instrument and a change in the overall frequency response of the instrument.

In accordance with my invention, a high density slab of brass or other such metal is placed between the headstock and the tuning gears of the instrument. The invention presently contemplates two versions or embodiments, one fixed version and one variable. Either is suitable for use in the construction of new guitars or for the enhancement of an already manufactured guitar. The addition of such a headplate to an otherwise conventional commerically available guitar materially improves the audible frequency response, i.e., the volume of frequencies between 220 HZ and 5000 HZ and will improve the instrument's sustain, i.e., the ime duration of string resonance.

BEST MODE FOR CARRYING OUT THE INVENTION

Figures 1, 2, 3, 4, 5:
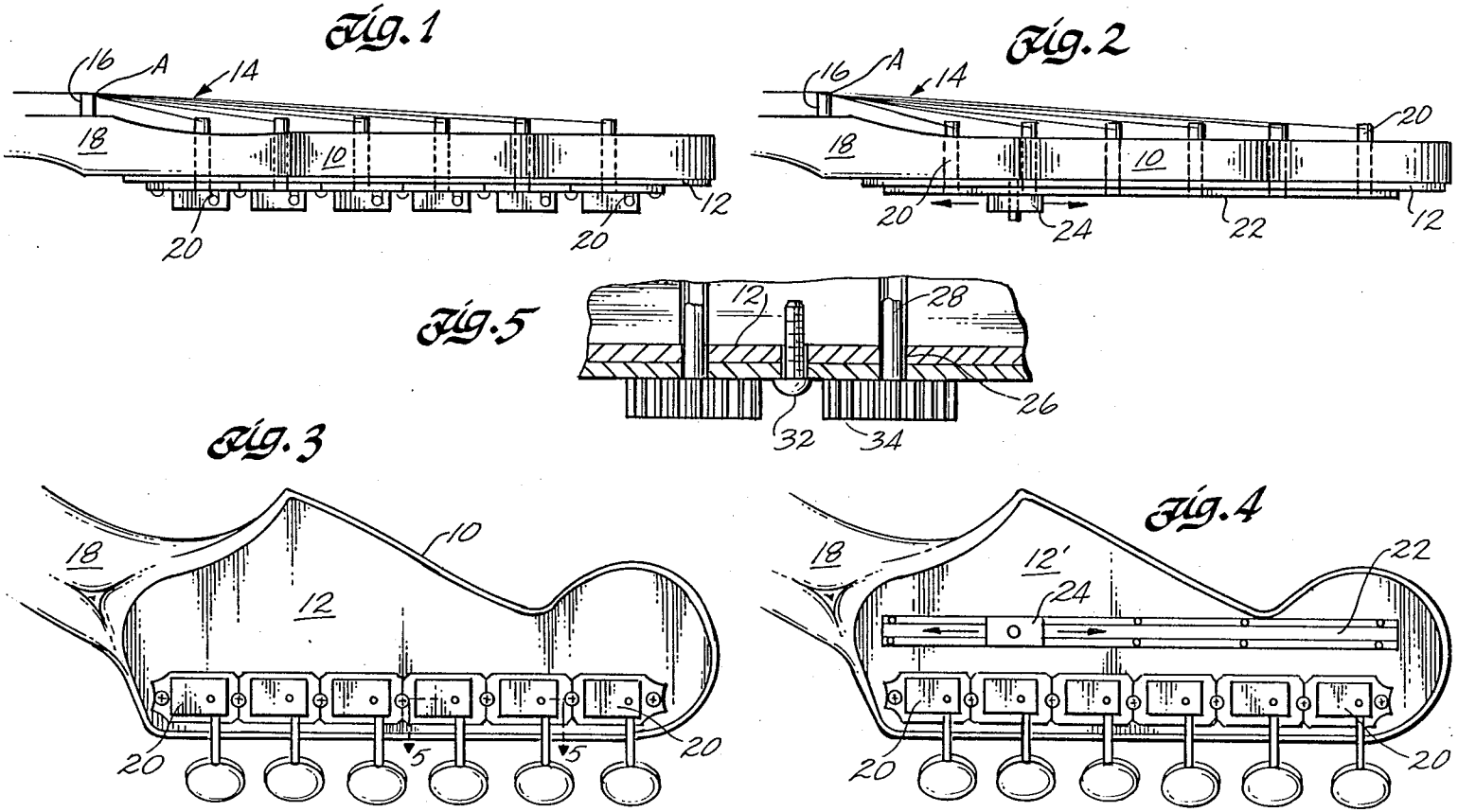
FIG. 1 is a side view of a guitar headstock showing a fixed version of the invention.
FIG. 2 is a side view of a guitar headstock with an adjustable version of the invention installed.
FIG. 3 is a top rear view of the guitar headstock of FIG. 1, showing the device outlining the shape of a particular style of headstock.
FIG. 4 is a top rear view of the guitar headstock of FIG. 2, showing the slotted groove in which the weight can slide to and fro.
FIG. 5 is an enlarged cross sectional view showing how the headplate and tuning machine may be fastened to the headstock by a common fastening means.

Referring to FIGS. 1 and 3, it may be seen that, in accordance with the present invention, an otherwise conventional guitar headstock 10 is provided with a headplate 12 made of brass or other such heavy metal. Plate 12 is preferably of about 1/16th of an inch in thickness although it will be somewhat effective with thicknesses as thin as 1/64th of an inch. The preferred thickness of the invention is 1/16th because this thickness allows the original tuning machines to be reinstalled with relative ease. A thicker headplate will further improve the audible acoustic effect only slightly and would require a special extended shaft tuning machine (not shown) to be fitted.

Varying the headplate 10 will change the angle A of the strings 14 as they pass over the nut 16. The increased angle at the nut is generally known by guitar makers to improve the tunability of the guitar and to give a sharper, clearer note as a result of the increased tension of the string against the nut. The addition of a headplate in accordance with my invention therefore has the resultant benefit of increasing the angle of the string without requiring any modification of the guitar neck 18 or of the tuning mechanisms 20.

Varying the thicknesses of the headplate 12 will also change the effective density of the headstock 10 and, I have found, will thereby also provide a substantial, audible improvement in the acoustic properties of the guitar accordingly.

FIGS. 2 and 4 show a presently preferred method of altering the weight and density of different portions of the headstock to optimize the acoustic effects of the latter aspect of the invention for a particular instrument. The illustrated adjustable headplate 12' (the inverted comma indicating a modification of a previously described element) has a slotted groove 22 that can accept several different weights 24 which slide up and down the length of the headstock 10 to alter the changes in frequency response and sustain of the instrument. In the interest of clarity, the lower portion of each individual tuning mechanism 20 has been omitted from FIG. 2 (it has however been shown in FIG. 4), so that the adjustable weight 24 and slotted groove 22 mounted to headplate 12' may be more clearly seen.

A major objective of the present invention is to improve the performance of already manufactured guitars. The invention as shown in FIGS. 1, 2, 3, and 4, is made in such a manner as to be readily retrofittable to the existing shape of the guitar's headstock. In particular, as shown in the enlarged cross sectional view of FIG. 5, it is made so as to fit between the headstock 10 and the plate portion the existing tuning machines 20, that is to say the holes 26 in the headplate are drilled in such a manner that the shafts 28 of the original tuning gears 20 will fit back into their holes 30 without drilling any new holes in the wood headstock 10 of the guitar. The headplate is held in place by the screws 32 of the tuning machines using the original screw holes 34 in the plate portion 35 of the tuning machine 20 and corresponding holes 36 provided in headplate 12. If an especially thick headplate 12 is utilized, replacement screws (not shown) should be utilized which have an increased length according to the thickness of the plate 12.

The invention as described in detail above has been found to materially improve the frequency response and the sustain of any already manufactured guitar. Sustain is a measure of the time or period of resonance of a string and the invention has been found to increase this resonance. The term "improved frequency response" as employed in connection with an electric guitar or bass relates to an increase in volume of frequencies between 220 cycles per second to 10,000 cycles per second. These improvements achieved by the present invention are, in fact, quite marked to the ear and materially enhance the effects that are and can be produced from either an acoustical or electric guitar or bass.

The present invention has been described above with regard to the physical structure, composition and use of certain presently contemplated specific embodiments of the invention. It will be appreciated to those skilled in the art that certain modifications and variations of the present invention are possible within the spirit and scope of the present invention, e.g., in the physical configuration and physical composition of the headplate and the provision of alternate or additional means to fasten the plate to the headstock.

What is claimed is:

1. In a stringed instrument having a body portion supporting a bridge and a neck terminated with a headstock having a tuning machine including a tuning gear support plate portion affixed thereto, with at least one string stretched between said bridge and said tuning machine: a separate metal headplate having a thickness between 1/64 inch and 1/16 inch and formed of brass and fastened between said headstock and said tuning gear support plate portion of said tuning machine.

2. The instrument of claim 1, wherein said tuning machine comprises a shaft extending upwardly through a first hole provided in said tuning gear support plate portion through a corresponding second hole provided in said headplate and then through a corresponding third hole provided in said headstock to a position above said headstock where it is connected to said string.

3. The instrument of claim 2, said instrument also having a nut at the headstock end of said neck, said string passing over said nut at a predetermined angle, wherein said predetermined angle is a function of the thickness of said headplate.

4. A headplate for a stringed instrument comprising a dense metallic plate and means for fastening said plate to a headstock portion of said instrument, wherein said headplate has a thickness of about 1/16th of an inch, is planar in form and is fabricated from a material having a density similar to that of brass, said headplate is separate from and configured to rest in planar contact with a plate portion of a tuning machine and said fastening means comprises a portion of said tuning machine mounting plate portion, and said headstock, said headplate and said plate portion of the tuning machine are provided with respective corresponding holes through which a tuning gear shaft may extend from below the tuning machine plate portion to a string above the headstock.

5. The headplate of claim 4 wherein said plate is fabricated from brass and has a thickness of at least 1/16th of an inch.

6. A method of modifying the headstock of a stringed instrument such as electric guitar or bass having a tuning machine attached to a lower surface of said headstock, said method comprising the steps of (a) removing said tuning machine from said headstock;

(b) placing a brass headplate separate and distinct from said tuning machine and having a thickness of at least 1/16 of an inch in direct contact with said lower surface at the location where the tuning machine was removed, and (c) re-attaching said tuning machine to said headstock with said headplate still in direct contact with said lower surface to thereby secure said headplate between said headstock and said tuning machine.

7. The method of claim 6 wherein said tuning machine comprises a shaft portion furthher comprising the step of passing said shaft portion through a correspnding hole provided in said headplate when said headplate is reattached to said headstock.

8. The method of claim 6 wherein said re-attaching step comprises attaching both said tuning machine and said headplate to said headstock by a common fastening means.

9. The method of claim 8 wherein said removing step comprises removing a screw and said common fastening means is said screw.

* * * * *

UNITED STATES PATENT AND TRADEMARK OFFICE

CERTIFICATE OF CORRECTION

PATENT NO. : 4,840,102

DATED : June 20, 1989

INVENTOR(S) : R. Aspen Pittman

It is certified that error appears in the above-identified patent and that said Letters Patent is hereby corrected as shown below:

Column 1, line 29, change "provding" to -- providing --.

Column 1, line 52, change "ime" to -- time --.

Column 4, line 36, change "furthher" to -- further --.

Column 4, lines 37,38, change "correspnding" to -- corresponding --.

Signed and Sealed this

Twenty-ninth Day of May, 1990

*Attest:*

*Attesting Officer*

HARRY F. MANBECK, JR.

*Commissioner of Patents and Trademarks*